US007042808B2

(12) United States Patent
Saitoh

(10) Patent No.: US 7,042,808 B2
(45) Date of Patent: May 9, 2006

(54) RADIO-CORRECTED TIMEPIECE

(75) Inventor: Yoritaka Saitoh, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 11/126,608

(22) Filed: May 11, 2005

(65) Prior Publication Data

US 2005/0259518 A1 Nov. 24, 2005

(30) Foreign Application Priority Data

May 19, 2004 (JP) ..... 2004-148935

(51) Int. Cl.
*G04C 11/02* (2006.01)

(52) U.S. Cl. ..... 368/47

(58) Field of Classification Search ..... 368/10, 368/46, 47, 49, 52; 455/343.2
See application file for complete search history.

(56) References Cited

U.S. PATENT DOCUMENTS 4,194,153 A * 3/1980 Masaki et al. ..... 340/7.33
5,036,500 A * 7/1991 Ganter ..... 368/47
5,444,672 A * 8/1995 Kushita ..... 368/47
5,528,560 A * 6/1996 Ogiyama ..... 368/47
5,898,643 A * 4/1999 Yasuoka et al. ..... 368/47
6,967,901 B1 * 11/2005 Shimizu ..... 368/47
2003/0198140 A1 * 10/2003 Shimizu ..... 368/47

FOREIGN PATENT DOCUMENTS

JP 2545662 6/1993
JP 2503376 2/1994

* cited by examiner

*Primary Examiner*—Vit W. Miska
(74) *Attorney, Agent, or Firm*—Adams & Wilks

(57) ABSTRACT

To make a time instant correction possible while suppressing an electric power consumption due to a reception of radio wave containing a time instant information. When a reception means has been made into its operation state in order to receive the radio wave containing plural markers disposed in predetermined positions and the time instant information, in a case where the marker initially received has been a reference marker M corresponding to an exact minute position, the time instant information is obtained by continuing the reception intact, and a time instant of a clock means is corrected and displayed to a display means. When the marker initially detected has been a position marker P, the reception means is made into its non-operation state. After 9 seconds from this point in time, the reception means is made again into the operation state in order to receive the reference marker M appearing after a constant time. This operation is repeated till the reference marker M can be detected, thereby performing the time instant correction.

6 Claims, 10 Drawing Sheets

FIG. 8

| END OF RECEPTION PROCESSING IN PREVIOUS OCCASION | | | BEGINNING OF RECEPTION PROCESSING IN NEXT OCCASION |
|---|---|---|---|
| RECEIVED TIME INSTANT | DISPLAYED TIME INSTANT | DIFFERENCE | PROCESSING |
| 00 | 03 | +3 | ON WHEN PRESENT TIME INSTANT - DIFFERENCE IS 57TH SECOND |
| 00 | 57 | −3 | ON WHEN DISPLAYED TIME INSTANT IS 57TH SECOND |

RADIO-CORRECTED TIMEPIECE

BACKGROUND OF THE INVENTION

1. Field of the Invention

The present invention relates to a radio-corrected timepiece in which a time instant is corrected on the basis of a time instant information received through radio wave.

2. Description of the Prior Art

From old times, there has been developed the radio-corrected timepiece in which the time instant is automatically corrected by receiving a radio signal representing an accurate time instant.

At present, in each of the countries (for example, Germany, Japan, the United States of America, England and the like), there is sent out a long wave standard wave, in which a time instant information has been superimposed, from a radio station provided in a predetermined place.

In Japan, under the jurisdiction of the Ministry of Public Management, there is transmitted the long wave standard wave in which such a time instant information as shown by a time code of FIG. 9 has been superimposed.

In FIG. 9, the time instant information is transmitted with one minute being made one frame and, therein, values of day, hour, minute and the like being one-pulse-width-modulated for one bit, and a rise of a forefront pulse (reference marker M) in one frame accurately synchronizes with 0th second.

The aforesaid radio signal is generated in every one second, and it follows that, if it is generated for 0.2 second in one second, a position marker P is shown and, if it is generated for 0.5 second, one second is shown and, if it is generated for 0.8 second, 0 is shown.

This position marker P is contained in one frame by plural number and, as shown by P1–P0 in FIG. 9, is a signal appearing in a break for every 10 seconds of 0th second (exact second), 9th second, 19th second, 29th second, 39th second, 49th second, and 59th second. Only at 59th second and 0th second, this position marker P continuously appears in one frame and, between these two continuous position markers P, the later position maker is referred to as the reference marker M, and the reference marker M becomes a signal representing an exact minute position. Since a position of a signal representing the time instant and the like in the frame is determined with this exact minute position (i.e., the reference marker M) being made a reference, it is possible to take out a time instant data by performing a detection of this exact minute position.

In a recent quartz timepiece, an accuracy of about 20 seconds in error per month can be easily realized and, if it is supposed that a time instant correction is performed once in one month for instance, since the error of one minute or longer scarcely exists, usually it suffices if only a second correction is performed. Accordingly, usually it suffices if only a 0th second information can be received, and other information is unnecessary. Whereupon, there has been one in which a time instant correction is performed by a reception of the forefront pulse (reference marker M) in the frame synchronizing with the 0th second while corresponding to a lead/lag of a displayed time instant (refer to Patent Document 1).

However, also in the above conventional radio-corrected timepiece, a power source of a reception means must be made always ON till the reference marker M showing the forefront of the signal representing the exact minute position is detected and, in a case where the reference marker M could not be detected, the reception must be continued for some extent, so that there is a problem that a wasteful electric power consumption is used.

On the other hand, there is one in which the time instant is corrected by judging a bit number to be taken in from when a P code in one frame has been received (refer to Patent Document 2), but there are such problems that its processing becomes intricate, and a capacity of ROM storing a processing program increases.

Incidentally, also in the United States, like a time code shown in FIG. 10, similarly to our country, as to the time instant information one minute is made one frame, therein a time instant information such as day, hour and minute is contained, the rise of the forefront pulse (reference marker FRM) in one frame accurately synchronizes with 0th second, and there are contained plural position markers P (P1–P0) with a predetermined interval. Accordingly, in a case where the invention described in each of the Patent Documents is applied to a standard wave signal of FIG. 10, there are similar problems. Besides Japan and the United States, in the country where the standard wave signal having such a time instant information as shown in FIG. 9 and FIG. 10 is used, there arise problems similar to the above.

<Patent Document 1> Japanese Patent No. 2545662 Gazette

<Patent Document 2> Japanese Patent No. 2503376 Gazette

A problem of the present invention is to make the time instant correction possible while suppressing the electric power consumption due to the reception of the radio wave containing the time instant information.

SUMMARY OF THE INVENTION

According to the present invention there is provided a radio-corrected timepiece possessing a reception means which receives radio wave containing a 1st marker showing an exact minute position, plural 2nd markers showing predetermined positions in a frame and a time instant information, a clock means which clocks a time instant, a display means which displays a clocked time instant of the clock means, and a control means which controls a supply of a power source to the reception means to thereby control the reception means to its operation state or non-operation state, characterized in that the control means controls such that in a case where, after the power source has been supplied to the reception means and it has been made into the operation state, a marker initially received by the reception means is the 2nd marker, an operation in which, after the reception means has been made into the non-operation state by interrupting the power source supply to the reception means, the power source is supplied again to the reception means after a predetermined time to thereby make it into the operation state is repeated till the 1st marker is received, and, in a case where the 1st marker has been received by the reception means, a reception operation of the reception means is continued to thereby obtain the time instant information and the clocked time instant of the clock means is corrected to the obtained time instant.

The control means controls such that in a case where, after the power source has been supplied to the reception means and it has been made into the operation state, a marker initially received by the reception means is the 2nd marker, an operation in which, after the reception means has been made into the non-operation state by interrupting the power source supply to the reception means, the power source is supplied again to the reception means after a predetermined time to thereby make it into the operation state is repeated till the 1st marker is received, and, in a case where the 1st marker has been received by the reception means, a reception operation of the reception means is continued to thereby obtain the time instant information and the clocked time instant of the clock means is corrected to the obtained time instant.

Here, it may be so constituted that the control means controls such that in a case where, after the power source has been supplied to the reception means and it has been made into the operation state, a marker initially received by the reception means is the 1st marker, the reception operation of the reception means is continued to thereby obtain the time instant information and the clocked time instant of the clock means is corrected to the obtained time instant.

Further, it may be so constituted that, in a case where the time instant information is obtained and successful in the time correction at a time instant correction time in a previous occasion, the control means calculates on the basis of the clocked time instant of the clock means a time instant before a predetermined time than a time instant receiving the 1st marker, and supplies the power source to the reception means at the time instant concerned to thereby make it into the operation state.

Further, it may be so constituted that it has a storage means and the control means calculates a time difference between the received time instant and the clocked time instant of the clock means and stores it to the storage means and, in a case where the time difference is in a predetermined range, calculates on the basis of the clocked time instant of the clock means a time instant before a predetermined time than a time instant receiving the 1st marker, and supplies the power source to the reception means at the time instant concerned to thereby make it into the operation state.

Further, it may be so constituted that, when the clocked time instant of the clock means has lagged than the received time instant in a case where the time difference stored in the storage means is larger than a predetermined value, the control means calculates on the basis of the clocked time instant of the clock means a time instant before a predetermined time than a time instant receiving the 1st marker, and supplies the power source to the reception means at the time instant concerned to thereby make it into the operation state.

Further, it may be so constituted that, when the clocked time instant of the clock means has led than the received time instant in a case where the time difference stored in the storage means is larger than a predetermined value, the control means calculates on the basis of a time instant obtained by subtracting the time difference from the clocked time instant of the clock means a time instant before a predetermined time than a time instant receiving the 1st marker, and supplies the power source to the reception means at the time instant concerned to thereby make it into the operation state.

BRIEF DESCRIPTION OF THE SEVERAL VIEWS OF THE DRAWINGS

A preferred form of the present invention is illustrated in the accompanying drawings in which:

FIG. 8 is a table for explaining processings of the radio-corrected timepiece concerning the 4th best mode of the present invention;

DETAILED DESCRIPTION OF THE PREFERRED EMBODIMENTS

Hereunder, it is explained about a radio-corrected timepiece concerning a best mode for carrying out the present invention.

Figure 1:
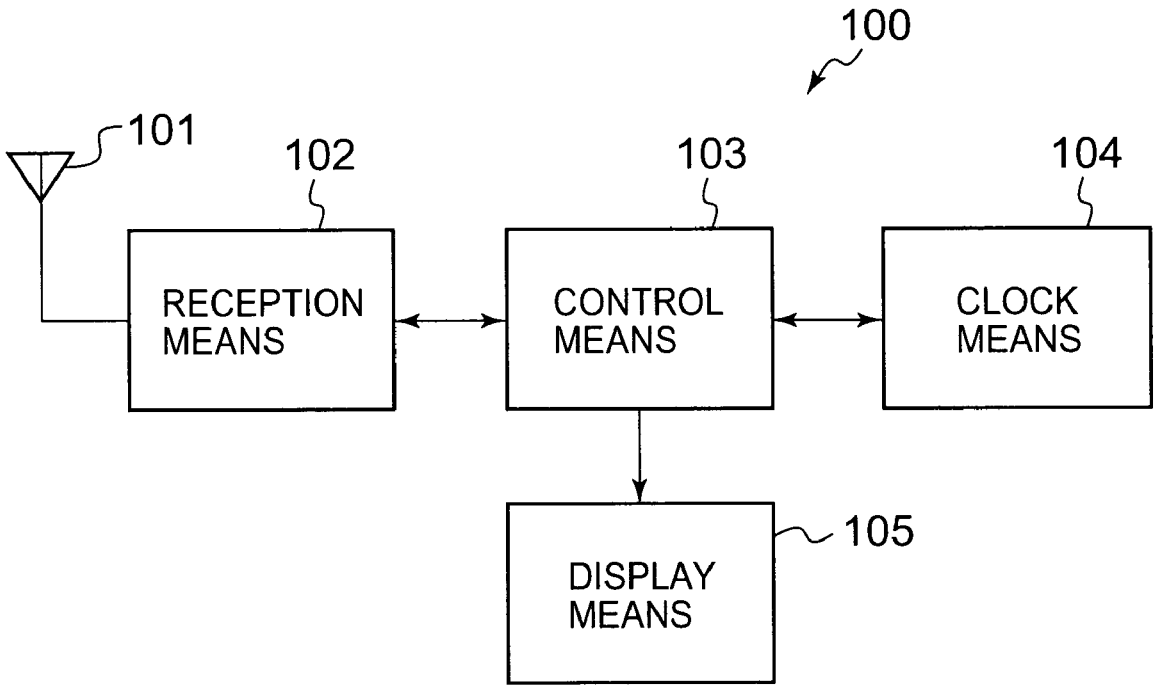
FIG. 1 is a block diagram of a radio-corrected timepiece concerning a 1st best mode of the present invention.
Figure 9:
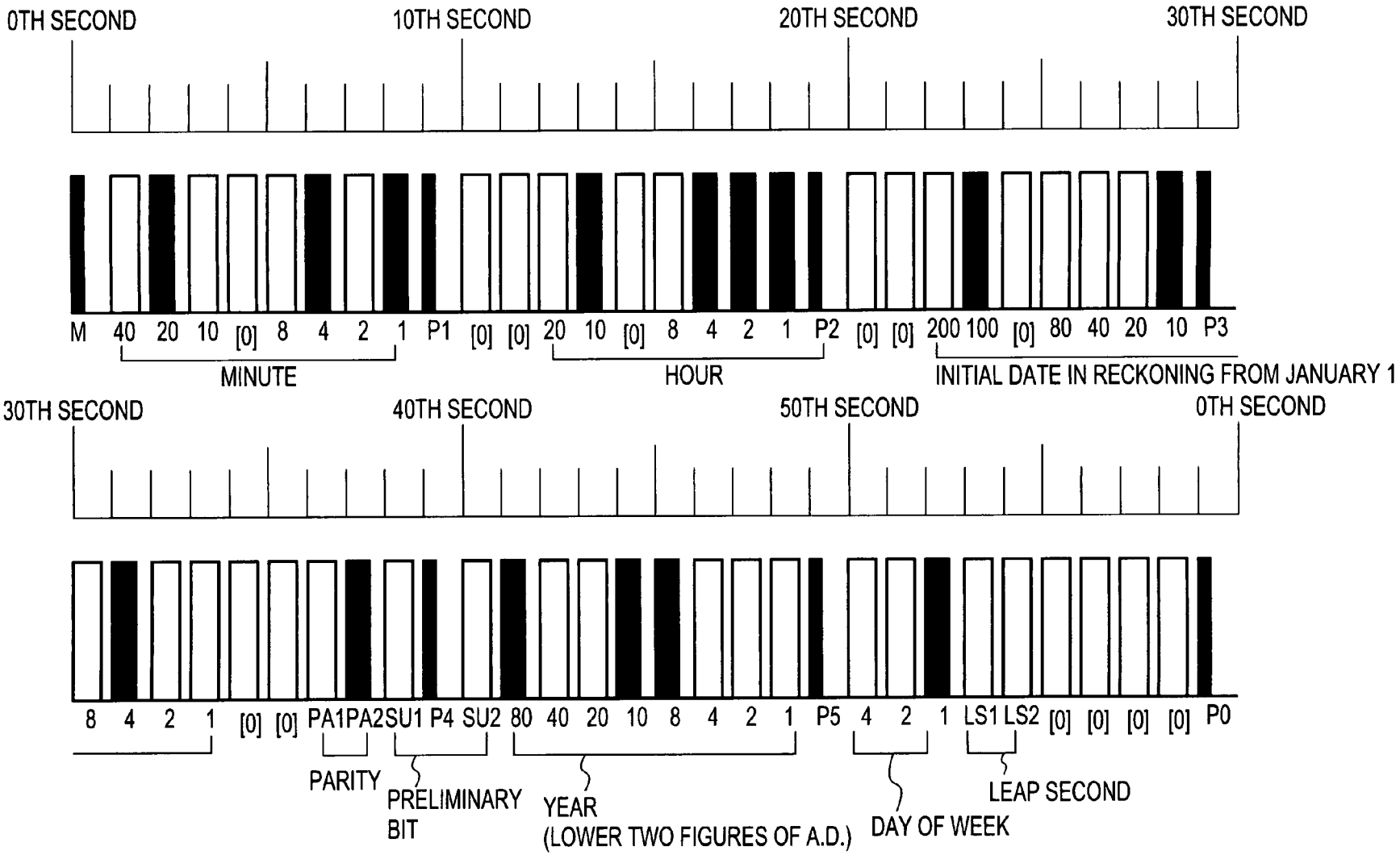
FIG. 9 is a diagram showing time codes of a standard wave used in Japan.
Figure 10:
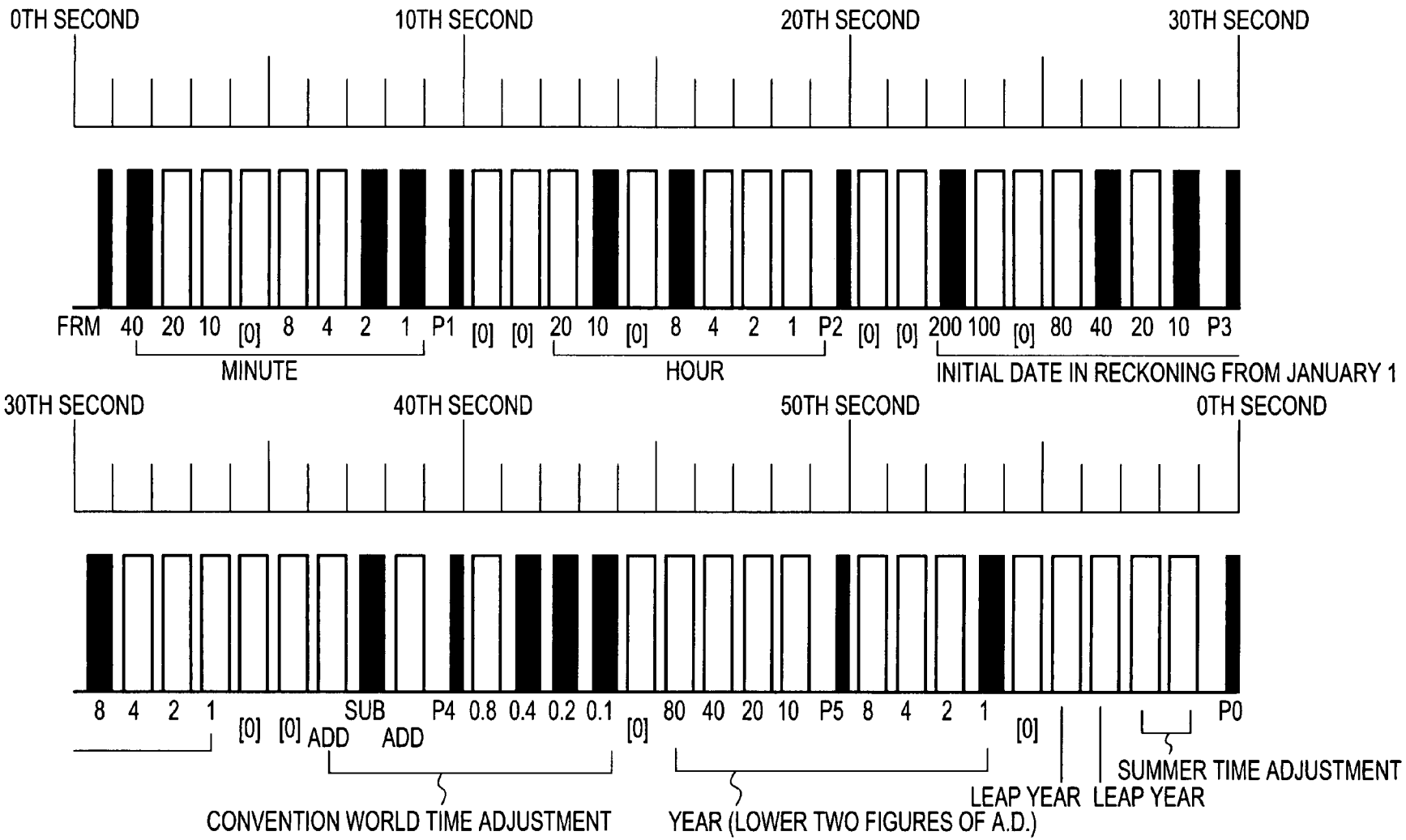
FIG. 10 is a diagram showing time codes of a standard wave used in the United States.

FIG. 1 is a block diagram of the radio-corrected timepiece concerning a 1st best mode of the present invention, and it is an example of the radio-corrected timepiece performing the time instant correction by using the standard wave signal of Japan shown in FIG. 9. As shown in FIG. 9, in the radio signal, there are contained the reference marker M as a 1st marker showing the exact minute position, the position markers P as plural 2nd markers showing predetermined positions in the frame, and the time instant information.

In FIG. 1, a radio-corrected timepiece 100 possesses a receiving antenna 101 for receiving a radio signal having the markers and the time instant information, a reception means 102 which is constituted by a reception circuit and demodulates the radio signal received by the receiving antenna 101 to thereby extract the markers M and P, the time instant information and the like, a control means 103 which controls each constituent element of the radio-corrected timepiece 100 and corrects a time instant being clocked by a clock means 104 on the basis of the time instant information extracted by the reception means 102, the clock means 104 which clocks the time instant, and a display means 105 which displays the time instant being clocked by the clock means 104. The control means 103 can be constituted by a central processing unit (CPU) and a storage means which stores a program that the CPU implements.

Figure 2:
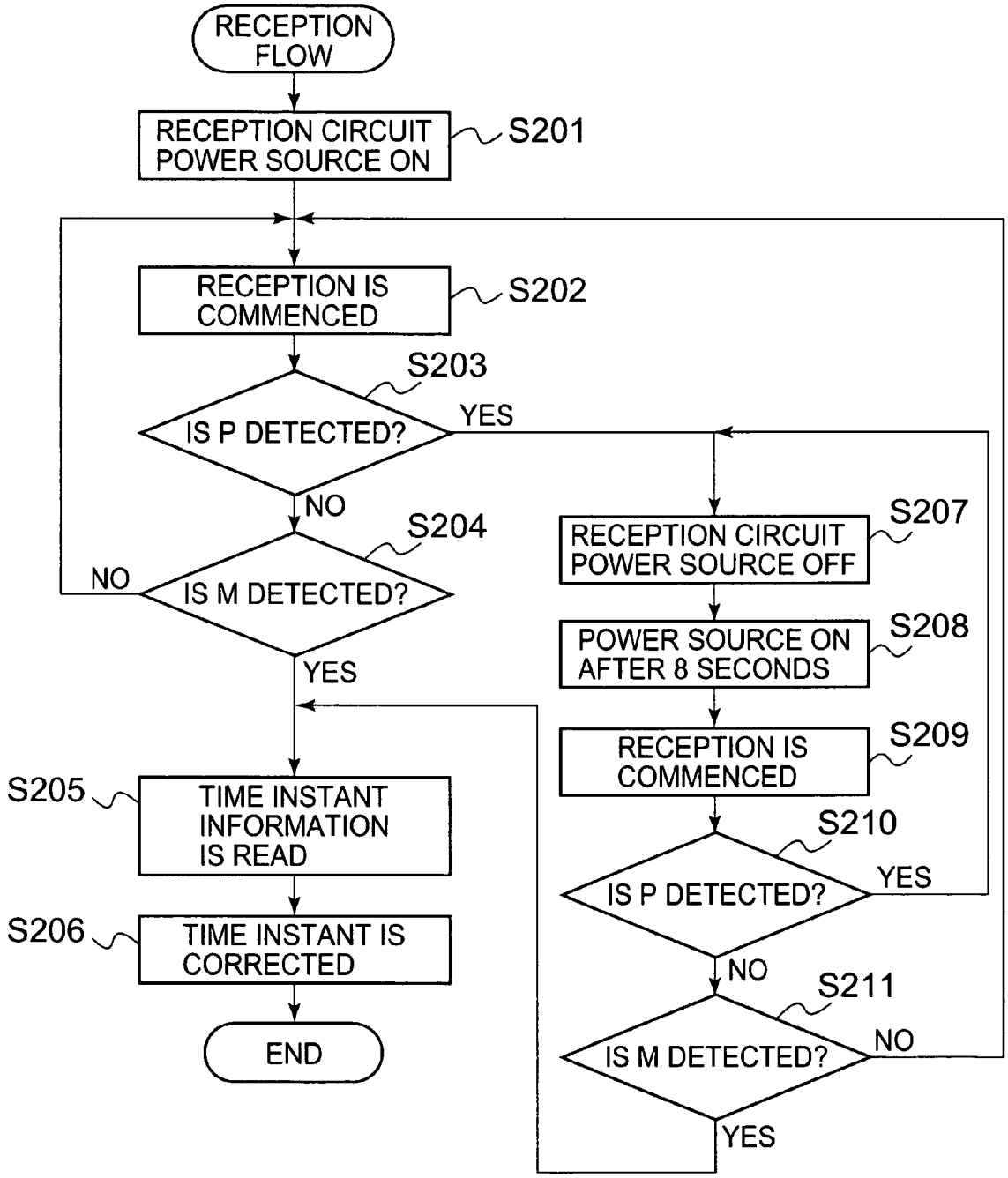
FIG. 2 is a flowchart showing processings of the radio-corrected timepiece concerning the 1st best mode of the present invention.
Figure 3A:
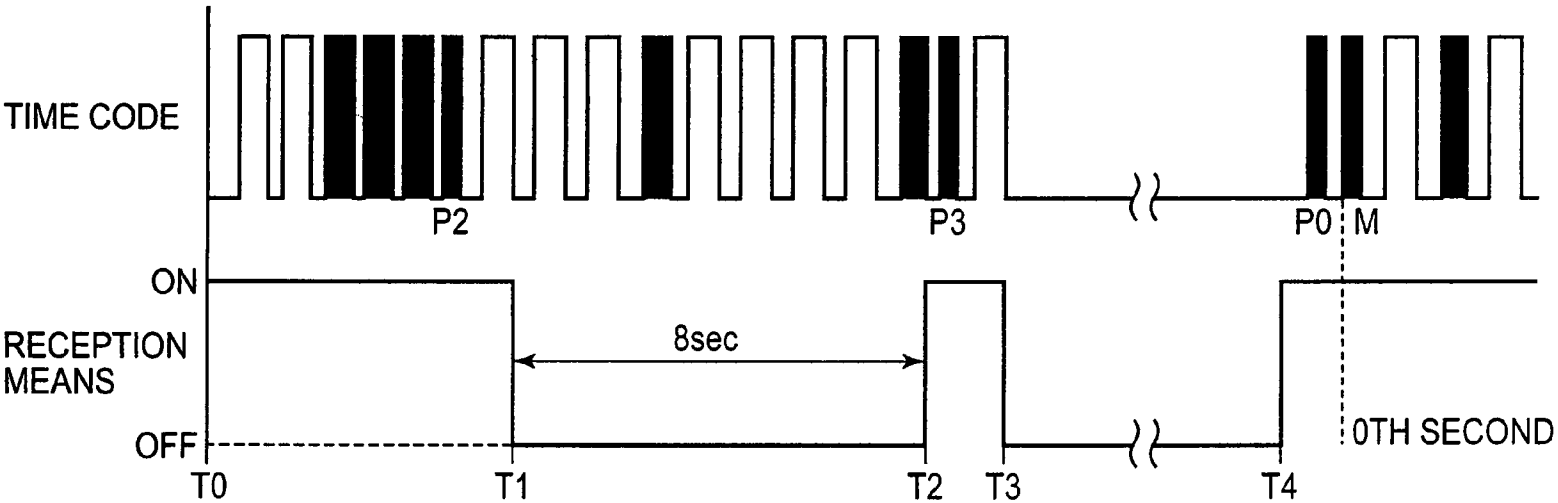
FIG. 3 is a timing diagram for explaining operations of the radio-corrected timepiece concerning the 1st best mode of the present invention.
Figure 3B:
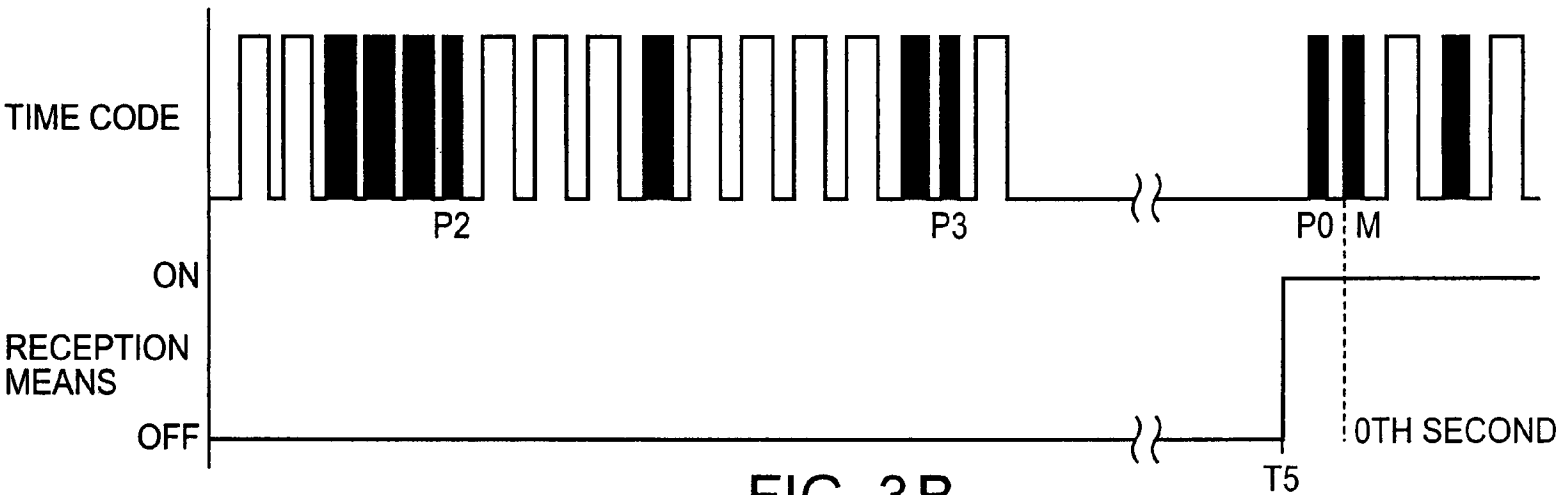

FIG. 2 is a flowchart showing processings of the best mode of FIG. 1. FIG. 3 is a timing diagram for explaining operations of the best mode of FIG. 1.

Hereunder, it is explained about the present 1st best mode by referring to FIG. 1–FIG. 3 and FIG. 9.

First, when the time instant being clocked by the clock means 104 has become a predetermined time instant or while responding to an operation of an operation means not shown in the drawing, the control means 103 supplies a power source to the reception means 102 to thereby control it to its operation state (power source ON), (step S201 in FIG. 2). The reception means 102 receives the power source and commences its reception operation (step S202).

The control means 103 judges, on the basis of a signal received by the reception means 102, whether or not any position marker P among the plural position markers P has been received and detected (step S203).

If it is judged in the step S203 that the position marker P as the 2nd marker is not received by the reception means 102, the control means 103 judges whether or not the reference marker M as the 1st marker has been received and detected (step S204).

If it is judged in the step S204 that the reference marker M has been received by the reception means 102, the control means 103 reads the time instant information contained in the standard wave signal (step S205), and corrects the time instant being clocked by the clock means 104 by replacing it with the above read time instant, thereby ending the processings (step S206).

If the control means 103 judges in the step S204 that the reference marker M is not received by the reception means 102, it returns to the step S202, and the aforesaid processings are performed.

If it is judged in the step S203 that the position marker P has been received by the reception means 102, the control means 103 interrupts the power source of the reception means 102 (power source OFF) (step S207) and, after a predetermined time (8 seconds in the present best mode) has elapsed, supplies the power source again to the reception means 102 (power source ON) (step S208).

The reception means 102 receives the power source and commences the reception operation again (step S209). The control means 103 judges, on the basis of the signal received by the reception 102, whether or not any position marker P among the plural position markers P has been received and detected (step S210).

If it is judged in the step S210 that the position marker P is not received by the reception means 102, the control means 103 judges whether or not the reference marker M has been received and detected (step S211).

In a case where the control means 103 has judged in the step S211 that the reference marker M has been received by the reception means 102, it shifts to the step S205 and, in a case where it has judged that the reference marker M is not received by the reception means 102, it shifts to the step S202 and the aforesaid processings are performed.

Further, if the control means 103 judges in the step S210 that the position marker P has been received by the reception means 102, it returns to the step S207, and the aforesaid processings are performed.

In explaining the above operations along the timing diagram of FIG. 3, at a time instant T0 in FIG. 3(*a*), if the control means 103 supplies the power source to the reception means 102 to thereby make the reception means 102 into its operation state (step S201 in FIG. 2), the reception means 102 receives the supply of the power source and commences the reception operation by for a previously determined time (step S202).

If it is judged that the position marker P has been received by the reception means 102 (step S203), the control means 103 interrupts the power source of the reception means 102 at a time instant T1 to thereby make the reception means 102 into its non-operation state (step S207) and, after such a predetermined time (8 seconds in the present best mode) that the reception means 102 can be made into its operation state has elapsed just before the next marker appears, supplies the power source again to the reception means 102 at a time instant T2, thereby making it into its operation state (step S208).

The reception means 102 commences again the reception operation at the time instant T2 by receiving the supply of the power source (step S209). The control means 103 judges, on the basis of the signal received by the reception means 102, whether or not any position marker P among the plural position markers P has been received and detected (step S210). If the control means 103 judges in the step S210 that the position marker P has been received by the reception means 102, it returns to the step S207, and it interrupts the power source of the reception means 102 at a time instant T3, and the operations similar to the above are repeated.

In a case where the control means 103 supplies the power source to the reception means 102 at a time instant T4 to make it into the operation state and it has been judged that the reference marker M has been received by the reception means 102 (step S211), it shifts to the step S205, thereby performing the processing of reading the time instant information and a correction processing of the time instant that the clock means 104 is clocking (step S206).

On the other hand, as shown in FIG. 3(*b*), at a time instant T5, if the control means 103 supplies the power source to the reception means 102 to make it into the operation state (step S201), the reception means 102 commences the reception operation (step S202) and the control means 103 judges in the step S204 that the reference marker M has been received by the reception means 102, the time instant information contained in the standard wave signal is read (step S205) and the time instant being clocked by the clock means 104 is corrected to the above read time instant, thereby ending the processings (step S206).

Like the above, in the radio-corrected timepiece concerning the present 1st best mode, when the reception means 102 is supplied with the power source and operated, in a case where an initially detected marker has been the reference marker M corresponding to the exact minute position, the reception is continues intact to obtain the time instant information, thereby correcting the time instant. In a case where the initially detected marker has been the position marker P, the power source of the reception means 102 is once interrupted. In order to detect the reference marker M appearing after a predetermined time (after 8 seconds in the present best mode) from that point in time, the power source is supplied again to the reception means 102 to make it into the operation state while being set to after the predetermined time (after 8 seconds). This operation is repeated till the reference marker M can be detected.

By this, it becomes possible to perform the time instant correction while shortening the current-carrying time of the reception means 102 as far as possible to thereby suppress the wasteful electric power consumption. Further, in the case of the radio-corrected timepiece driven by the battery, there are brought about advantages that the prolongation of battery life and the reduction in the number of times of battery exchange can be realized and thus its troublesomeness can be solved.

Figure 4:
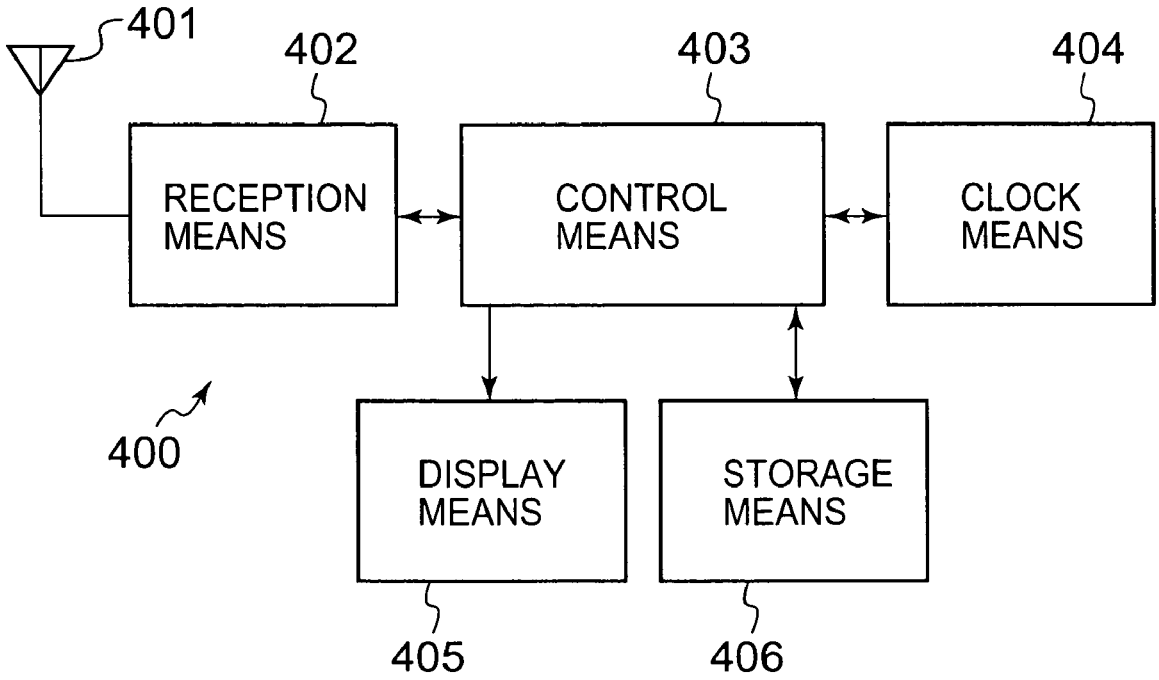
FIG. 4 is a block diagram of the radio-corrected timepiece concerning 2nd to 4th best modes of the present invention.

FIG. 4 is a block diagram of the radio-corrected timepiece concerning a 2nd best mode of the present invention, and it is the example of the radio-corrected timepiece performing the time instant correction by using the standard wave signal of Japan shown in FIG. 9. In FIG. 4, a radio-corrected timepiece 400 possesses a receiving antenna 401 for receiving a radio signal having the markers and the time instant information, a reception means 402 which is constituted by a reception circuit and demodulates the radio signal received by the receiving antenna 401 to thereby extract the time instant information, a control means 403 which controls each constituent element of the radio-corrected timepiece 400 and corrects a time instant being clocked by a clock means 404 on the basis of the time instant information extracted by the reception means 402, the clock means 404 which clocks the time, a display means 405 which displays the time instant being clocked by the clock means 404, and a storage means 406 which stores a timing time for supplying a power source to the reception means 402 to thereby make it into its operation state. The control means 103 can be realized by being constituted by a central processing unit (CPU) and storing a program that the CPU implements in the storage means 406.

Figure 5:
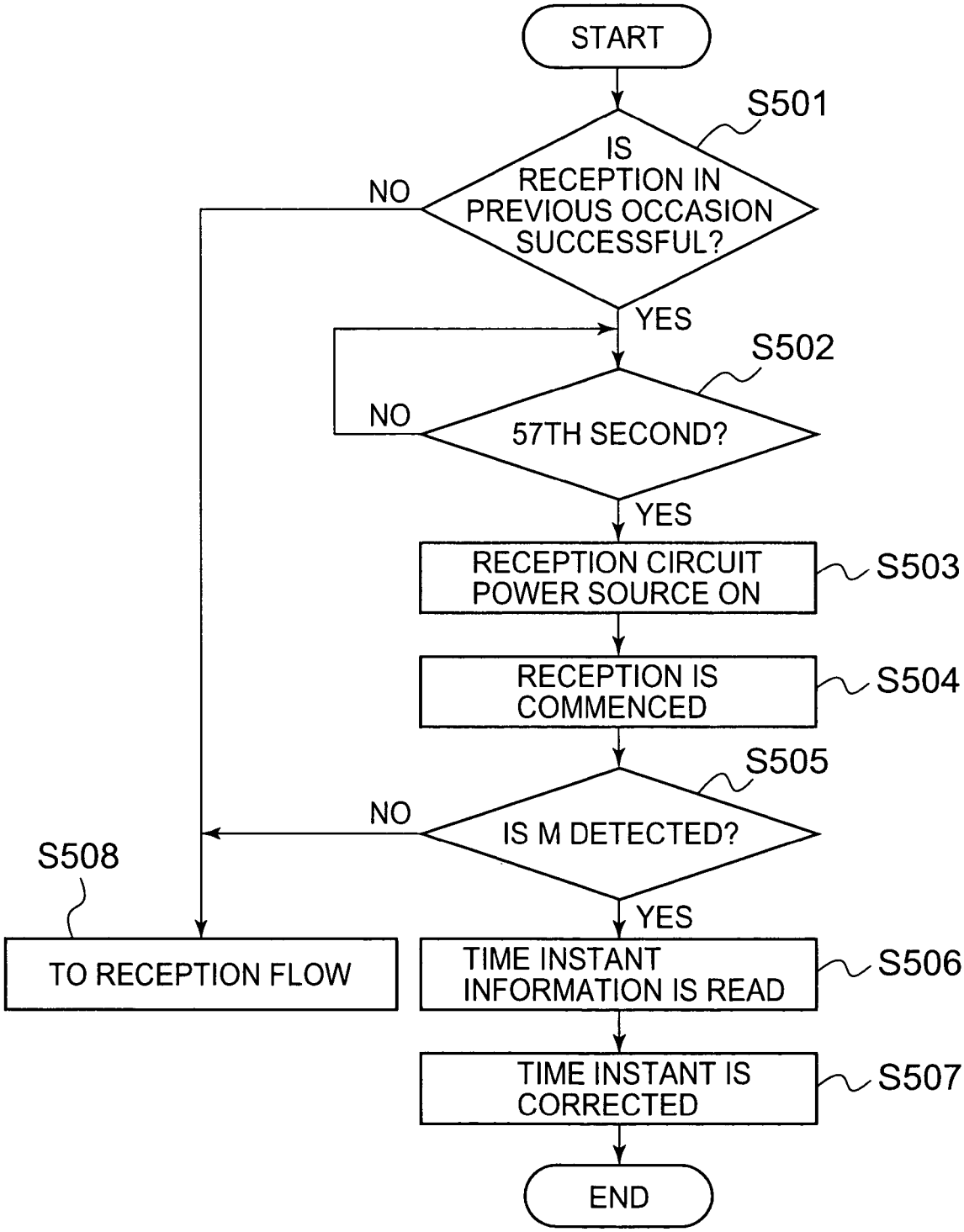
FIG. 5 is a flowchart showing processings of the radio-corrected timepiece concerning the 2nd best mode of the present invention.

FIG. 5 is a flowchart showing processings of the best mode of FIG. 4. Hereunder, it is explained about the present 2nd best mode by using FIG. 4 and FIG. 5.

First, the control means 403 judges whether or not, in a previous occasion, the time instant correction is successful by receiving the time instant information contained in the standard wave signal (step S501) and, in a case where it is not successful in the previous occasion, it shifts to the reception flow of FIG. 2, thereby performing the aforesaid processings (step S508).

In a case where it is successful in the previous occasion, the control means 403 deems that the time instant being clocked by the clock means 404 is approximately accurate, and waits on the basis of the time instant that the clock means 404 is clocking till it becomes a time instant (57th second in the present best mode) before a predetermined time of a time instant receiving the reference marker M corresponding to the exact minute position (step S502). The above time instant before the predetermined time is beforehand stored in the storage means 406, and the control means 403 reads the above time instant stored in the storage means 406 and waits till it becomes the time instant concerned.

In a case where it has been judged in the step S502 that it has become the above time instant (57th second) before the predetermined time, if the control means 403 supplies the power source to the reception means 402 to thereby control it to the operation state (step S503), the reception means 402 receives the supply of the power source and commences the reception operation (step S504).

Next, the control means 403 judges whether or not the reference marker M has been received by the reception means 402 (step S505).

If it is judged in the step S505 that the reference marker M is not received, the control means 403 judges that a timing for making the reception means 402 into the operation state deviates, and it shifts to the step S508, thereby performing the processings of the reception flow of FIG. 2.

If it is judged in the step S505 that the reference marker M has been received by the reception means 402, the control means 403 reads the time instant information contained in the standard wave signal (step S506), and corrects the time instant being clocked by the clock means 404 by replacing it with the above read time instant, thereby ending the processings (step S507). The above time instant after the correction is displayed to the display means 405.

Like the above, according to radio-corrected timepiece 400 concerning the present 2nd best mode, if in the previous occasion it is successful in the time instant correction by receiving the time instant information, the timing for supplying the power source to the reception means 402 to thereby make it into the operation state is made the time instant (e.g., 57th second) before the predetermined time of the time instant receiving the reference marker M corresponding to the exact minute position, on the basis of the time instant being clocked by the clock means 404 (in other words, displayed time instant being displayed by the display means 405). Accordingly, since the time instant correction becomes possible if the power source is supplied to the reception means 402 by for a short time, it becomes possible to more suppress the electric power consumption. Provisionally, even in a case where the time instant correction could not be performed by the above processings, it is possible to perform the time instant correction in a manner similar to the above 1st best mode, and it becomes possible to save the electric power.

Next, it is explained about the radio-corrected timepiece concerning a 3rd best mode. A block diagram of the radio-corrected timepiece concerning the present 3rd best mode is the same as FIG. 4, and it is the example of the radio-corrected timepiece performing the time instant correction by using the standard wave signal of Japan shown in FIG. 9.

In explaining an outline of the present 3rd best mode, in the storage means 406, a time difference (how many seconds are leading or lagging) between a time instant received through the radio wave and a time instant displayed in the display means 405 (in other words, a time instant being clocked by the clock means 404) is judged at the end of a time instant information reception processing in the previous occasion, and that time difference is stored in the storage means 406. If the above time difference becomes larger than a predetermined time, on the basis of the displayed time instant (i.e., the time instant being clocked by the clock means 404) of the display means 405, the power source is supplied to the reception means 402 before the predetermined time (e.g., 57 seconds) receiving the reference marker M corresponding to the exact minute position, and thus the reception means 402 is made into its operation state. The above predetermined time is beforehand stored in the storage means 406.

In a case where a difference between the time instant received by the radio signal and the time instant displayed in the display means 405 is larger than a predetermined range, or in a case where it is impossible to detect the reference marker M, the same processings as the above 1st best mode are performed.

Figure 6:
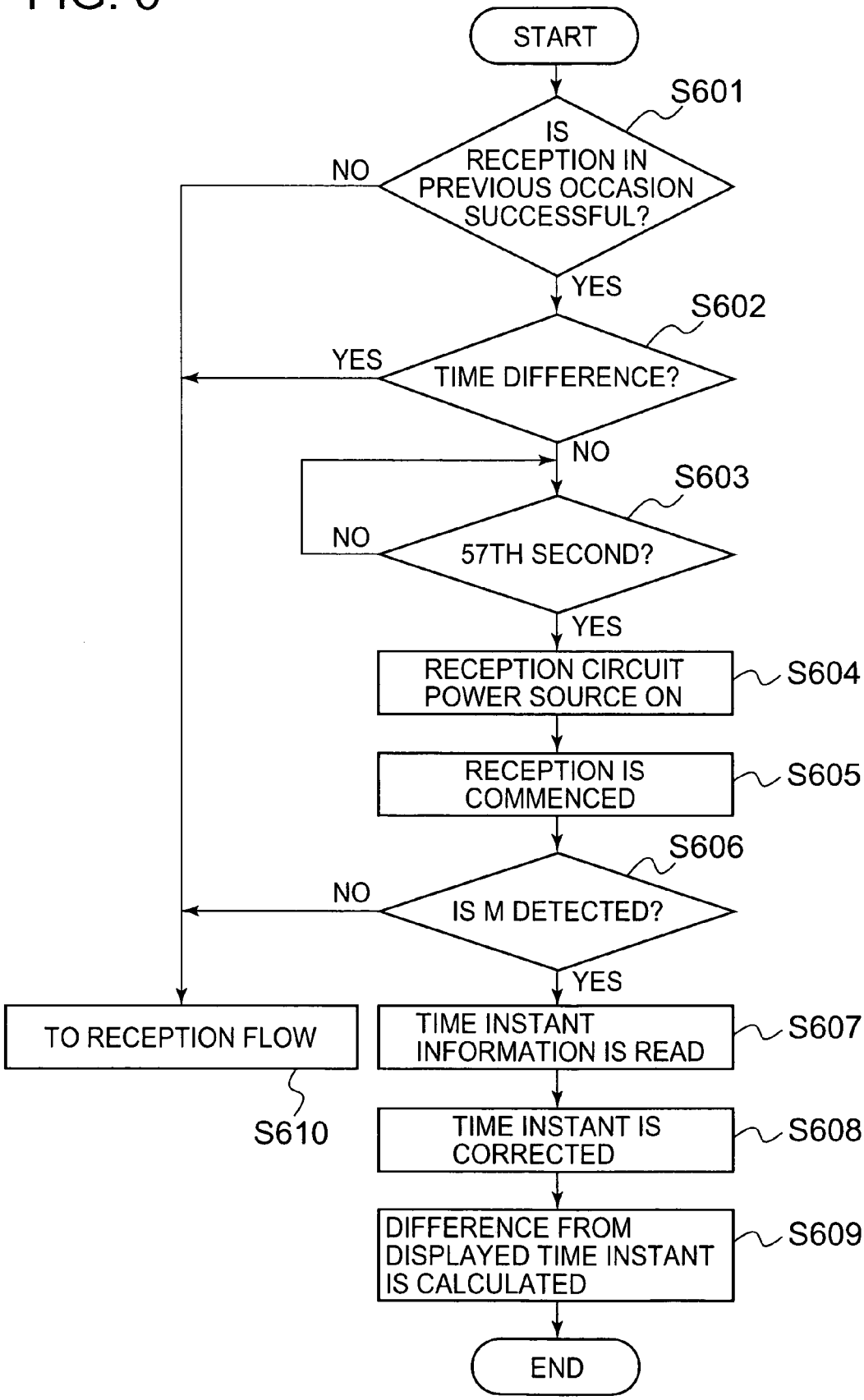
FIG. 6 is a flowchart showing processings of the radio-corrected timepiece concerning the 3rd best mode of the present invention.

FIG. 6 is a flowchart of the processings of the present 3rd best mode. Hereunder, it is explained about the present 3rd best mode by using FIG. 4 and FIG. 6.

First, the control means 403 judges whether or not, in a previous occasion, the time instant correction is successful by receiving the time instant information contained in the standard wave signal (step S601) and, in a case where it is not successful in the previous occasion, it shifts to the reception flow of FIG. 2, thereby performing the aforesaid processings (step S610).

In a case where it is successful in the previous occasion, the control means 403 judges by referring to a data of the time difference stored in the storage means 406 whether or not the time difference between the time instant information contained in the radio signal and the time instant being clocked by the clock means 404 is larger than a predetermined value (step S602).

In a case where it has been judged in the step S602 that the above time difference is larger than the predetermined value, the control means 403 judges that the time instant clocked by the clock means 404 is inaccurate, and it shifts to the step S610, thereby performing the processings of the above reception flow.

In a case where it has been judged in the step S602 that the above time difference is smaller than the predetermined value, the control means 403 judges that the time instant clocked by the clock means 404 is accurate, and waits on the basis of the time instant that the clock means 404 is clocking till it becomes a time instant (57th second in the present best mode) before a predetermined time of a time instant receiving the reference marker M corresponding to the exact minute position (step S603). The above time instant before the predetermined time is beforehand stored in the storage means 406, and the control means 403 reads the above predetermined time stored in the storage means 406 and waits till it becomes the time concerned.

In a case where it has been judged in the step S603 that it has become the above time instant (57th second) before the predetermined time, if the control means 403 supplies the power source to the reception means 402 to thereby control it to the operation state (step S604), the reception means 402 receives the supply of the power source and commences the reception operation (step S605).

Next, the control means 403 judges whether or not the reference marker M has been received by the reception means 402 (step S606).

If it is judged in the step S606 that reception means 402 does not receive the reference marker M, the control means 403 judges that a timing for making the reception means 402 into the operation state deviates, and it shifts to the step S610, thereby performing the processings of the reception flow FIG. 2.

If it is judged in the step S606 that the reference marker M has been received by the reception means 402, the control means 403 reads the time instant information contained in the standard wave signal (step S607), and corrects the time instant being clocked by the clock means 404 by replacing it with the above read time instant (step S608). The above time instant after the correction is displayed to the display means 405. Thereafter, the time difference between the time instant information contained in the radio signal and the time instant having been being clocked by the clock means 404 is calculated, and the above time difference is stored in the storage means 406, thereby ending the processings (step S609).

Like the above, according to radio-corrected timepiece 400 concerning the present 3rd best mode, since the timing for making the reception means 402 into the operation state is determined on the basis of the time difference between the time instant received by the radio signal at the end of the time instant information reception processing in the previous occasion and the time instant being clocked by the clock means 404, the time instant correction becomes possible by operating the reception means 402 by for a shorter time. Therefore, it becomes possible to save the electric power consumption and the time instant correction becomes possible. Incidentally, in a case where the difference between the time instant received by the radio signal and the time instant clocked by the clock means 404 does not exist in a predetermined range, or in a case where the reference marker M cannot be detected, the advantages similar to the above 1st best mode are obtained.

Next, it is explained about the radio-corrected timepiece concerning a 4th best mode. A block diagram of the radio-corrected timepiece concerning the present 4th best mode is the same as FIG. 4, and it is the example of the radio-corrected timepiece performing the time instant correction by using the standard wave signal of Japan shown in FIG. 9.

In explaining an outline of the present 4th best mode, it is adapted such that, in the above 3rd best mode, in a case where the above time difference outside the predetermined range has been detected, the processings are changed in compliance with a quantity of the above time difference. It is adapted such that, at the end of the time instant correction processing in the previous occasion, the time difference between the time instant received through the radio wave and the displayed time instant of the display means 405 (i.e., the time instant having been being clocked by the clock means 404) is taken and stored in the storage means 406 and, in a case where the displayed time instant of the display means 405 has lagged than the received time instant (a case of −) at a time instant correction processing time in the previous occasion, the correction is performed while being set to the displayed time instant in this occasion and, in a case where the above displayed time instant has led than the received time instant (a case of +), the correction is performed while being set to a time instant obtained by subtracting the above time difference from the time instant being clocked by the clock means 404 (in other words, the time instant being displayed by the display means 405).

Figure 7:
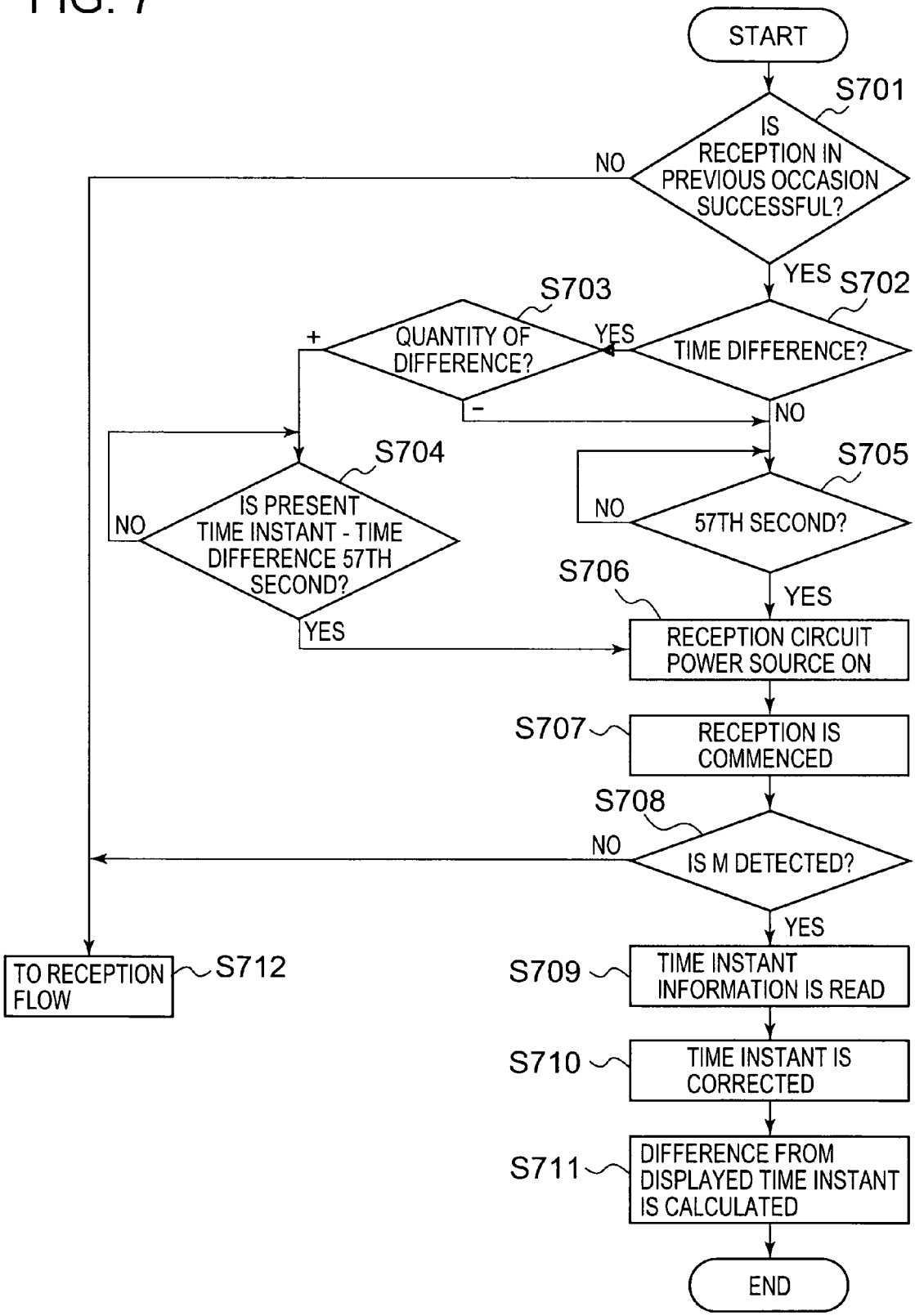
FIG. 7 is a flowchart showing processings of the radio-corrected timepiece concerning the 4th best mode of the present invention.

FIG. 7 is a flowchart of the processings of the present 4th best mode. Further, FIG. 8 is a table showing a relation between the timing for making the reception means 402 into the operation state and the above time difference in the present 4th best mode.

Hereunder, operations of the present 4th best mode are explained by using FIG. 4, FIG. 7 and FIG. 8.

First, the control means 403 judges whether or not, in a previous occasion, the time instant correction is successful by receiving the time instant information contained in the standard wave signal (step S701) and, in a case where it is not successful in the previous occasion, it shifts to the reception flow of FIG. 2, thereby performing the aforesaid processings (step S712).

In a case where it is successful in the previous occasion, the control means 403 judges by referring to a data of the time difference stored in the storage means 406 whether or not the above time difference is larger than a predetermined range (step S702).

In a case where it has been judged in the step S702 that the above time difference is larger than the predetermined range, the control means 403 judges that the time instant clocked by the clock means 404 is inaccurate, and judges whether the time instant clocked by the clock means 404 has led or lagged than the time instant contained in the radio signal, i.e., whether the above quantity of the time difference is + or − (step S703).

In a case where it has been judged in the step S702 that the above time difference is in the predetermined range, or in a case where it has been judged in the step S703 that the time instant clocked by the clock means 404 lags (the above time difference is −), it shifts to a step S705, and waits on the basis of the time instant (i.e., the displayed time instant) that the clock means 404 is clocking till it becomes a time instant (57th second in the present best mode) before a predetermined time of a time instant receiving the reference marker M corresponding to the exact minute position (step S705). The above time instant before the predetermined time is beforehand stored in the storage means 406, and the control means 403 reads the above time instant before the predetermined time stored in the storage means 406 and waits till it becomes the time instant concerned.

In a case where it has been judged in the step S702 that the time instant clocked by the clock means 404 leads (the time difference is +), the control means 403 waits on the basis of a time instant obtained by subtracting the above clocked time instant (present time instant) by the clock means 404 and the above time difference till it becomes the time instant (57th second in the present best mode) before the predetermined time of the time instant receiving the reference marker M corresponding to the exact minute position (step S704).

In a case where it has been judged in the step S704 and the step S705 that it has become the above time instant (57th second) before the predetermined time, if the control means 403 supplies the power source to the reception means 402 to thereby control it to the operation state (step S706), the reception means 402 receives the supply of the power source and commences the reception operation (step S707).

Next, the control means 403 judges whether or not the reference marker M has been received by the reception means 402 (step S708).

If it is judged in the step S708 that reception means 402 does not receive the reference marker M, the control means 403 judges that a timing for making the reception means 402 into the operation state deviates, and it shifts to the step S712, thereby performing the processings of the reception flow of FIG. 2.

If it is judged in the step S708 that the reference marker M has been received by the reception means 402, the control means 403 reads the time instant information contained in the standard wave signal (step S709), and corrects the time instant being clocked by the clock means 404 by replacing it with the above read time instant (step S710). The above time instant after the correction is displayed to the display means 405.

Thereafter, the time difference between the time instant information contained in the radio signal and the time instant having been being clocked by the clock means 404 is calculated, and the above time difference is stored in the storage means 406, thereby ending the processings (step S711).

Like the above, according to the radio-corrected timepiece 400 concerning the present 4th best mode, it is adapted such that, in a case where the fact has been detected that the time difference between the time instant received through the radio wave and the time instant being clocked by the clock means 404 is outside the predetermined range, the processings are changed in compliance with a quantity of the above time difference. For example, it is adapted such that, in the case where the above time difference is –, the correction is performed while being set to the displayed time instant and, in the case where the above time difference is +, the correction is performed while being set to the time instant obtained by subtracting the above time difference from the displayed time instant of the clock means 404. By this, it becomes possible to save the electric power consumption and the time instant correction becomes possible. Incidentally,in the case where the reception is unsuccessful in the previous occasion, or in the case where the reference marker M cannot be detected, it follows that the advantages similar to the above 1st best mode are obtained.

It can be applied to the radio-corrected timepiece utilized in a country, such as the United States not only Japan, where there is used, as the standard wave for the time instant correction, the radio wave containing the marker showing the exact minute position, the plural markers showing the predetermined positions in the frame, and the time instant information.

According to the present invention, it becomes possible to perform the time instant correction while shortening a current-carrying time of the reception means as far as possible to thereby suppress the wasteful electric power consumption. By this, in a case of the radio-corrected timepiece driven by a battery, there are brought about advantages that a prolongation of battery life and a reduction in the number of times of battery exchange can be realized and thus its troublesomeness can be solved.

What is claimed is:

1. A radio-corrected timepiece comprising:

a reception means for receiving radio wave containing a 1st marker showing an exact minute position, plural 2nd markers showing predetermined positions in a frame and a time instant information;

a clock means for clocking a time instant;

a display means for displaying a clocked time instant of the clock means; and a control means for controlling a supply of a power source to the reception means to thereby control the reception means to its operation state or non-operation state, wherein the control means controls such that in a case where, after the power source has been supplied to the reception means and it has been made into the operation state, a marker initially received by the reception means is the 2nd marker, an operation in which, after the reception means has been made into the non-operation state by interrupting the power source supply to the reception means, the power source is supplied again to the reception means after a predetermined time to thereby make it into the operation state is repeated till the 1st marker is received, and in a case where the 1st marker has been received by the reception means, a reception operation of the reception means is continued to thereby obtain the time instant information and the displayed time instant of the clock means is corrected to the obtained time instant.

2. A radio-corrected timepiece according to claim 1, wherein the control means controls such that in a case where, after the power source has been supplied to the reception means and it has been made into the operation state, a marker initially received by the reception means is the 1st marker, the reception operation of the reception means is continued to thereby obtain the time instant information and the clocked time instant of the clock means is corrected to the obtained time instant.

3. A radio-corrected timepiece according to claim 1, wherein in a case where the time instant information is obtained and successful in the time correction at a time instant correction time in a previous occasion, the control means calculates on the basis of the clocked time instant of the clock means a time instant before a predetermined time than a time instant receiving the 1st marker, and supplies the power source to the reception means at the time instant concerned to thereby make it into the operation state.

4. A radio-corrected timepiece according to claim 1, further comprising a storage means;

wherein the control means calculates a time difference between the received time instant and the clocked time instant of the clock means and stores it to the storage means and, in a case where the time difference is in a predetermined range, calculates on the basis of the clocked time instant of the clock means a time instant before a predetermined time than a time instant receiving the 1st marker, and supplies the power source to the reception means at the time instant concerned to thereby make it into the operation state.

5. A radio-corrected timepiece according to claim 4, wherein when the clocked time instant of the clock means has lagged than the received time instant in a case where the time difference stored in the storage means is larger than a predetermined value, the control means calculates on the basis of the clocked time instant of the clock means a time instant before a predetermined time than a time instant receiving the 1st marker, and supplies the power source to the reception means at the time instant concerned to thereby make it into the operation state.

6. A radio-corrected timepiece according to claim 5, wherein when the clocked time instant of the clock means has led than the received time instant in a case where the time difference stored in the storage means is larger than a predetermined value, the control means calculates on the basis of a time instant obtained by subtracting the time difference from the clocked time instant of the clock means a time instant before a predetermined time than a time instant receiving the 1st marker, and supplies the power source to the reception means at the time instant concerned to thereby make it into the operation state.

* * * * *